United States Patent [19]

Fapiano

[11] 4,261,190

[45] Apr. 14, 1981

[54] FLATNESS CONTROL IN HOT STRIP MILL

[75] Inventor: Donald J. Fapiano, Salem, Va.

[73] Assignee: General Electric Company, Salem, Va.

[21] Appl. No.: 61,614

[22] Filed: Jul. 30, 1979

[51] Int. Cl.[3] ..... B21B 37/00

[52] U.S. Cl. ..... 72/6; 72/205; 72/17

[58] Field of Search ..... 72/6–12, 72/17, 205

[56] References Cited

U.S. PATENT DOCUMENTS

| | | | |
|---|---|---|---|
| 3,387,470 | 6/1968 | Smith, Jr. | 72/8 |
| 3,459,019 | 8/1969 | Stone | 72/12 |
| 3,630,058 | 12/1971 | Fapiano | 72/6 |
| 4,137,741 | 2/1979 | Fapiano et al. | 72/19 |

FOREIGN PATENT DOCUMENTS

| | | | |
|---|---|---|---|
| 50-18869 | 7/1965 | Japan | 72/9 |

OTHER PUBLICATIONS

Article "Automatic Shape Control for Hoogovens 88-Inch Hot Strip Mill" by Hollander & Reinen-of record in the appln. dated Apr. 1975, presented to Assoc. of Iron & Stl. Engrs. [Appeared in Iron & Steel Engr. in the Apr. 1976 issue].

Article-"A New Approach to the Computer Set-up of a Hot Strip Mill" by Wilmotte et al.

*Primary Examiner*—Milton S. Mehr

*Attorney, Agent, or Firm*—Arnold E. Renner

[57] ABSTRACT

The flatness of metal strip being rolled in a hot strip mill is improved by applying higher than normal interstand tensions with maximum permissible tensions being based upon preestablished maximum allowable width reductions due to interstand tensions. The relationships between interstand tension and interstand plastic deformation are predetermined functions of strip material properties, strip temperature, and assumed tensile stress distribution across the strip width.

12 Claims, 10 Drawing Figures

FLATNESS CONTROL IN HOT STRIP MILL

CROSS-REFERENCE TO RELATED PATENTS

WORKPIECE SHAPE CONTROL, U.S. Pat. No. 4,137,741, issued Feb. 6, 1979 to D. J. Fapiano, et al and assigned to the assignee of the present invention, here the "Shape Control Patent", the disclosure of which is incorporated herein by reference.

COMPUTER CONTROLLED SYSTEM FOR METALS ROLLING MILL, U.S. Pat. No. Re. 26,996, issued Dec. 8, 1970 to R. G. Beadle et al and assigned to the assignee of the present invention, here the "Computer Control Patent", the disclosure of which is incorporated herein by reference.

BACKGROUND OF THE INVENTION

1. Field of the Invention

The present invention relates to the rolling of metal strips and, more particularly, to techniques for maintaining the strips flat during the rolling process.

2. Prior Art

Sheet metal is produced by rolling slabs, bars, or other relatively massive workpieces into thin, elongated strips. Although finish rolling often occurs near room temperature (cold rolling), the initial workpiece reduction from its slab form is done at elevated temperature in a facility known as a hot strip mill. The product of the hot strip mill may be further processed and further reduced in thickness, or it may be sold directly for applications requiring thicker strip materials. Where hot-rolled strip is an intermediate product subject to further rolling, its width and thickness dimensions may be somewhat less critical than where it is the final product. In either case, however, its flatness, or freedom from waviness, is important since excess waviness interferes with both subsequent processing and eventual fabrication of the strip into a finished product.

Waviness in rolled strip results from unequal elongation across the strip width due to unequal percentage thickness reduction across the strip width. A region of strip which is elongated more than other strip regions will exhibit waviness.

In order to reduce the thickness of the strip, the strip is passed between successive stands having two opposed rolls which are designed to support large rolling forces. In a "two high" stand only two rolls are present, while in a "four high" stand upper and lower work rolls contact the strip and are themselves contacted by upper and lower backup rolls of much larger diameter. Even the relatively rigid "four high" assembly experiences deflection under the bending effort of rolling forces which range from 500 to 3000 tons in strip rolling applications. To compensate for deflection, the work rolls may be ground, or contoured, so that their diameters at mid-length are greater than their diameter at the ends. This diameter difference is referred to as roll "crown".

Roll crown is not constant during a rolling operation, but varies as the roll temperature increases or decreases through contact with (a) the hot workpiece and (b) cooling water used in the process. Roll crown changes due to nonuniform temperature variations across the roll may exceed 0.01 inch. During the rolling process, the roll crown is further altered by surface wear in the regions of contact with the workpiece. Work rolls are changed relatively frequently to maintain good surface conditions but may exhibit wear in excess of 0.01 inch. In addition to work roll dimension changes, backup rolls wear due to friction from their contact with the work rolls. Although backup roll wear rates are much lower than work roll wear rates, the time between backup roll changes is sufficiently greater than the accumulated wear may be of the same order as work roll wear.

These roll crown-influencing factors combine at each mill stand to produce some strip thickness variation across strip width. The difference between strip thickness near its edge and at its center is referred to as "strip crown". With the exception of roll wear, all of the factors which influence roll crown and roll deflection can be used to control strip crown. Roll temperature can be controlled by the use of roll coolant. Deflection can be controlled by proper choice of thickness reduction which determines the associated roll separating force. Roll grinding practices normally are chosen to be compatible with the planned rolling practice. Finally, supplementary roll bending systems can be provided to alter the effective roll crown by applying bending moments to the work rolls or backup rolls with hydraulic cylinders.

Whatever the method of controlling roll crown and strip crown, the strip crowns in successive rolling stands must result in essentially equal elongation of all elements of the strip across its width or waviness eventually will result. Equal element elongation will be achieved if all strip elements receive identical percentage thickness reductions in each rolling stand. Expressed another way, the percent strip crown must be maintained essentially constant during the successive reductions in thickness.

These concepts are well understood in the context of both cold rolling and hot rolling. In hot rolling, most recent techniques have attempted to meet the constant percentage thickness reduction requirement by proper choice of thickness reduction and associated rolling force. These methods attempt to model mathematically the thermal roll crown changes in the work rolls, the wear pattern in the work rolls and backup rolls, and the deflection of the work rolls under nonuniform roll separating forces. These methods then attempt to choose a thickness reduction such that the combination of roll crown factors and roll deflection factors produces a delivery strip crown which bears the proper relationship to the entry strip crown at each rolling stand. In some variations of this strategy, the calculations are limited to the last three or four rolling stands.

While this prior art strategy produces somewhat better results than strategies which take no account of entry and delivery strip crown relationships, it is obvious that in the absence of flatness feedback, the results often will be unreliable. That is, the prior techniques are "predictive" because they calculate in advance the expected results of a rolling schedule and do not rely on measured values to determine if in fact the proper strip crown relationships are being produced. The difficulties inherent in a predictive approach can be appreciated by recognizing that a workpiece 0.1 inch thick produced with a strip crown 0.001 inch greater than a crown produced under conditions of uniform elongation will experience approximately 0.1 percent less elongation at the center than at the edges. The extra edge elongation will produce an edge waviness of about 0.8 inch amplitude, in the absence of tension. Since uncertainties in the actual loaded roll surface configuration will often exceed 0.001 inch, it is clear that waviness easily can occur with even the most sophisticated predictive technique.

Prior art strip crown control techniques in hot strip mills have analyzed the waviness problem without taking tension between roll stands into account or by assuming that interstand tension is negligible. It is well known in cold rolling to provide substantial tension between successive roll stands. This is done primarily to reduce the roll force required to effect the desired thickness reduction. It also is recognized that interstand tension acts as an aid to flatness control. The use of relatively high interstand tension has been possible in cold rolling because the elastic limits of a typical workpiece at or near room temperature are very high. Interstand tensile stresses may therefore be maintained correspondingly high without exceeding the elastic limits of the strip and, therefore, without causing undesirable interstand plastic deformation.

It is further known in cold rolling applications that nonuniform tension distributions which would have resulted from nonuniform elongation across strip width are attenuated by an amount which depends upon the length of the arc of contact, the thickness of the workpiece and the elastic moduli of the workpiece and rolls. Davies ("Preduction and Control of Strip Flatness in Cold Rolling"—W. E. Davies, et al, *Metals Technology*, October 1975) gives the following expression for attenuation, A, of roll crown errors in the presence of tension:

$$A = 1 + 6\frac{l}{h} \cdot \frac{E_S}{E_R}$$

wherein:

l=arc of contact h=outgoing thickness $E_s$=elastic modulus of strip $E_R$=elastic modulus of roll.

In this respect, interstand tension influences are similar for hot and cold rolling applications. The fact that interstand tension exhibits this flatness correcting effect in hot rolling applications has probably been neglected because (1) it has been generally assumed that interstand tension levels are negligible in hot rolling, and (2) it has been incorrectly assumed that the modulus of elasticity of the workpiece at rolling temperatures is too low to significantly influence tension profiles.

In hot rolling, moreover, prior attempts to employ other than minimal interstand tensions, insufficient to have any noticeable effect on strip flatness, have met with inconsistent and sometimes highly unsatisfactory results. Because the factors governing interstand plastic deformation have been insufficiently understood, the results of these prior attempts have varied so that in some instances no appreciable effect was observed, while at other times severe reductions in width, or necking resulted. In extreme cases, interstand plastic deformation has been so drastic as to result in breaking of the strip.

SUMMARY OF THE INVENTION

It is, therefore, an object of the present invention to provide a method for employing interstand tension as an active flatness control parameter in a hot metal rolling mill.

It is another object to provide a method of flatness control in a hot metal rolling process which employs relatively high controlled interstand tensions derived as a function of determinable workpiece characteristics.

It is a further object to provide a method of flatness control in a hot metal rolling mill which employs appreciable interstand tension in a controlled and predictable manner.

The foregoing and other objects are achieved in accordance with the method of the present invention which overcomes the major problems associated with the use of high interstand tensions and provides an effective, controllable technique for improving strip flatness in hot strip mills. Essentially, the invention first determines an acceptable workpiece width reduction due to plastic flow between each pair of roll stands. Based on (a) the acceptable width reduction, (b) the initial strip width, (c) the transport time between each pair of roll stands, and (d) an assumed relationship between transverse and longitudinal strain, longitudinal strain rates are calculated. These strain rates then are used to select allowable tension levels from stored relationships between stress and strain rate for the particular grade of material and for the average temperature in each interstand space. The selected tensile stresses are converted to interstand tensile force and applied as references to a conventionally supplied interstand tension regulation system.

In a preferred embodiment, interstand stress levels are stored as linear functions of the logarithm of strain rate for representative operating temperatures and for material groups having similar tension-strain rate characteristics. Preferably, the stress levels are reduced to compensate for some amount of tension non-uniformity, since nonuniform tension produces more width reduction than does uniform tension.

BRIEF DESCRIPTION OF THE DRAWING

While the present invention is described in particularity in the claims annexed to and forming a part of this specification, a better understanding of the invention can be had by reference to the following description taken in conjunction with the accompanying drawing in which:

DESCRIPTION OF THE PREFERRED EMBODIMENT

Figure 1:
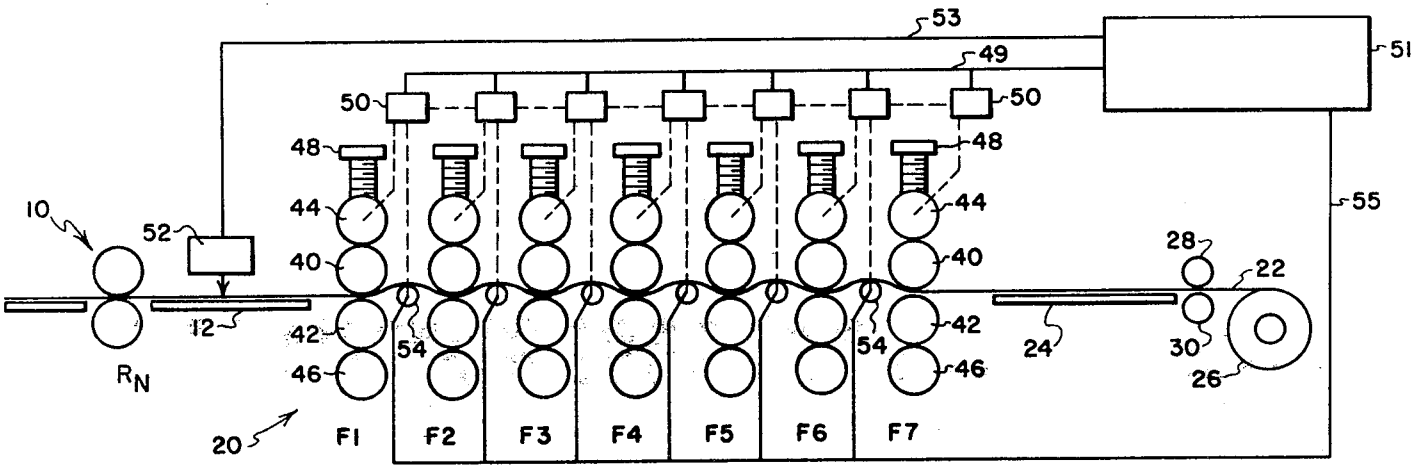
FIG. 1 is a simplified schematic view of a hot strip mill in which the present invention may be practiced.

In a hot strip mill, the initial reductions of the thickness of a metal slab are taken in a set of tandem mill stands known collectively as a roughing train. FIG. 1 shows in greatly simplified form the last stand $R_N$ of a roughing train 10 along with other components in a hot strip mill. As the slab emerges from the stand $R_N$, it moves across a mill table 12 toward a finishing train 20 consisting of mill stands F1, F2, F3, F4, F5, F6 and F7 arranged in tandem. The final reductions in thickness are taken in the finishing train 20 to produce a metal strip 22 which may be, for example, 1,000 or more feet in length, two to seven feet in width, and 0.05 to 0.5 inch in thickness.

As a typical example, during its passage through the roughing train 10 and the finishing train 20, the strip 22 gradually is cooled from its initial temperature of about 2200 degrees Fahrenheit (°F.). By the time the strip 22 reaches stand F7, it has cooled to around 1600° F. to 1700° F. As the strip 22 emerges from the last stand F7 in the finishing train 20, it traverses a cooling or runout table 24 before being coiled by a coiler 26. Strip tension during the coiling operation is maintained a pair of pinch rolls 28, 30 located at the coiler end of the runout table 24.

As illustrated in FIG. 1, each stand in the finishing train 20 includes an upper work roll 40 and a lower work roll 42. Upper and lower backup rolls 44, 46 are pressed against the upper and lower work rolls 40, 42, respectively, during a rolling operation to prevent excessive distortion of the work rolls 40, 42. This configuration is known as a four high mill. Each mill stand includes roll-adjusting screws 48 to regulate the opening between the upper and lower work rolls 40, 42. The rolls of each mill stand are rotated by independently controllable electric motors having motor controls, all indicated schematically by the numeral 50. By rotating the motors 50 at different speeds with respect to each other, the tension applied to a strip 22 passing through the finishing train 20 can be controlled. Customarily, in a modern automated mill, the determination of the individual motor (roll) speeds is the result of computations performed by a suitable computer 51 (for example, a Honeywell 4000 Series). The computations employ various parameters of the strip itself (for example, composition, size, temperature, etc.) as well as operating parameters of the mill (for example, roll force, thickness reduction, etc.) all as is well known in the art. As an example, reference is made to the Computer Control Patent. The control link between the motors and their controls 50 and the computer 51 is schematically illustrated by a bus 49.

A metal sensor 52 is located a short distance upstream of the first mill stand F1. The metal sensor 52 is positioned above the mill table 12 and senses when the beginning and the end of a strip 22 are approaching the first mill stand F1. The metal sensor 52 generates a signal which is sent to the computer 51 via a line 53. A looper 54 is positioned between each mill stand and is in contact with the underside of a strip 22 during its passage through the finishing train 20. The loopers 54 are in communication with the computer 51 by way of a line 55. The loopers 54 serve to maintain a desired strip loop between mill stands as well as a desired preset tension. Looper positions are maintained through adjustments of the adjacent work roll speeds. The strip tension is determined by the looper and strip geometry and by looper torque motor current. Alternatively, a suitable tensiometer such as is known in the art may be used to sense interstand tension and provide the requisite feedback signals.

Figure 2:
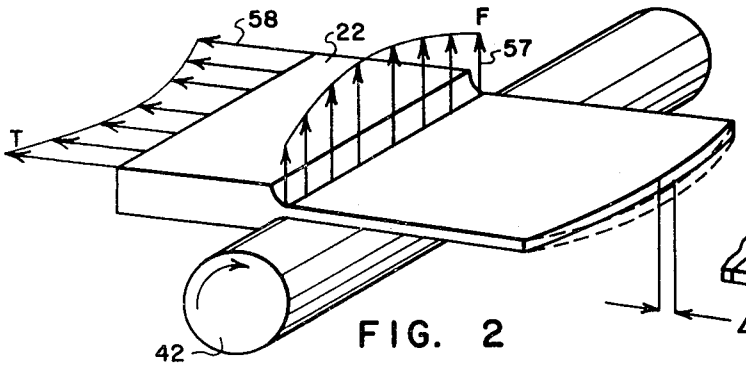
FIG. 2 is a schematic representation of the interaction between interstand tension distribution and rolling force distribution.

FIG. 2 is a schematic representation of a metal strip 22 as it is deformed during its passage through the finishing train 20. Only the lower work roll 42 is shown for purposes of clarity. Under normal rolling conditions, the work rolls 40, 42 are subjected to roll separating forces of between 500–3,000 tons. The work rolls 40, 42 are supported along their entire length by the backup rolls 44, 46 to prevent excessive bending. Even though the resulting roll assembly is relatively rigid, the large roll separating forces produce roll deflections which are significant when compared with the thickness of the strip being rolled. Since the backup rolls 44, 46 are supported only at their ends by the roll adjusting screws 48, deflections tend to be greater near the center of the workpiece than near the edge of the workpiece. Typically, the work rolls 40, 42 are contoured to have a slightly larger diameter at their midlength than at their ends in an attempt to compensate for expected roll deflections. Furthermore, the combined action of roll cooling water, which is distributed over the full length of the work rolls 40, 42, as well as heat conducted from the strip 22 causes relatively more thermal expansion at the mid-length of the rolls 40, 42 than at the ends of the rolls 40, 42. This thermal expansion is influenced by the length of the rolling contact arc, the temperature of the strip 22, the temperature of the rolls 40, 42, the temperature of the cooling water, the rolling speed, and the width of the strip 22, among other factors. The effective roll crown is further influenced by surface wear of the work rolls 40, 42 which also is nonuniform and is influenced by many unpredictable factors. The backup rolls 44, 46 wear more slowly than the work rolls 40, 42 but the backup rolls 40, 46 are retained longer in the mill stand and experience accumulated wear comparable to that of the work rolls 40, 42. Although mathematical models have been proposed for calculating roll thermal crowns, none of these models have been completely effective in the presence of the unmeasurable variations in many of the controlling factors.

All of the foregoing factors combine to produce a thickness variation across the width of the strip 22 as the strip 22 is reduced in thickness between the work rolls 40, 42. It is well known that the crown imparted to the strip 22 (strip crown) as the strip 22 exits the work rolls 40, 42 must bear a specific relationship to the strip crown upon entry to the work rolls 40, 42 if good strip flatness is to be maintained. Specifically, the percentage strip crown must be maintained approximately constant at each stage of strip thickness reduction from the initial to final thickness in the hot strip mill. In the earlier stands, some deviation from constant percent crown is permissible, the amount of deviation depending upon the thickness, width and temperature of the strip 22. In the latter stands, particularly when rolling thin, wide strips, very little deviation from constant percent crown is permissible.

As earlier indicated, interstand tension can improve strip flatness in a rolling mill through interaction with roll gap forces. In hot rolling, the gap force tension interaction is supplemented by two additional mechanisms associated with interstand flow.

FIG. 2 illustrates the relationship between interstand tension and roll force profiles when the roll gap configuration is such as to produce more elongation at workpiece center than at workpiece edges. In the presence of interstand tension this condition will reduce the tension at workpiece center and increase the tension at workpiece edges as illustrated by the arrows 58. Since the workpiece yields when the combined stress equals the yield stress, the tension profile will produce the nonuniform force profile illustrated by the arrows 57. The higher roll separating force in the workpiece central region will produce more roll deformation there than in the regions corresponding to the workpiece edges. As a result, the workpiece crown will be increased and the elongation at workpiece center reduced compared to that which would have occurred in the absence of tension. The reduced elongation is represented in FIG. 2 by dimension $\Delta L$, the dotted line representing the condition which would have occurred in the absence of interstand tension. This is similar to that occurring in cold rolling, as previously noted.

It will be understood from the previous illustration that the average interstand tension level is significant since higher tension will accommodate larger tension differentials before any element of workpiece width falls to zero tension and manifest waviness appears.

Figure 3:
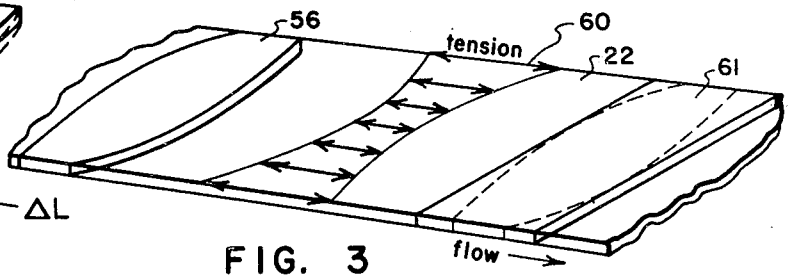
FIG. 3 schematically represents the relationship between interstand tension distribution and interstand plastic flow.

It is in the interstand workpiece behavior that the differences between hot and cold rolling applications become most significant. Interstand flow in the presence of tension is nonexistent in cold rolling but may be significant in hot rolling. This interstand flow influences width, which is generally considered undersirable, while it has two beneficial influences on flatness. FIG. 3 illustrates one of these actions. Consider an element of strip leaving one of a pair of mill stands with excessive elongation as shown by section 56. Tensile stress at the workpiece edges would be greater than at the centerline, the tension distribution taking the form illustrated by the arrows 60. During the time interval in which the workpiece section proceeds from a first to a second of the stand pairs all of the workpiece section experiences some flow or creep, the regions of the sections under greater tension experiencing greater flow. When the workpiece element arrives at the second stand, its edges have been elongated more than its center and the conditions which would have given rise to waviness thus have been partially compensated as demonstrated at 61 wherein the dotted lines again show the condition in the absence of tension.

While not shown in FIG. 3, it will be understood that the edge regions of the workpiece in this example will not only have undergone more elongation that the central regions, but additionally the edge thickness will have been reduced more than the central thickness and the transverse flow or width reduction in the edge regions will be greater than that in the central regions.

The thickness changing influence of the interstand tension differential acts to further amplify the roll force pattern illustrated in FIG. 2. The greater reducton of edge gauge reduces the relative reduction and associated roll separating force in the edge regions, assisting the previously described action of the tension profile.

A quantitative understanding of these phenomena requires knowledge of the "creep" or strain-rate behavior of the workpiece at rolling temperatures and practical interstand tensile stress levels. *The Journal of Applied Mechanics,* June 1941, "High-Speed Tension Tests at Elevated Temperatures —Parts II ad III" by Nadai et al gives some data for mild steel. Additional laboratory results performed by the assignee of the present invention are in general agreement with the earlier published results but cover a broader range of materials.

Figure 4:
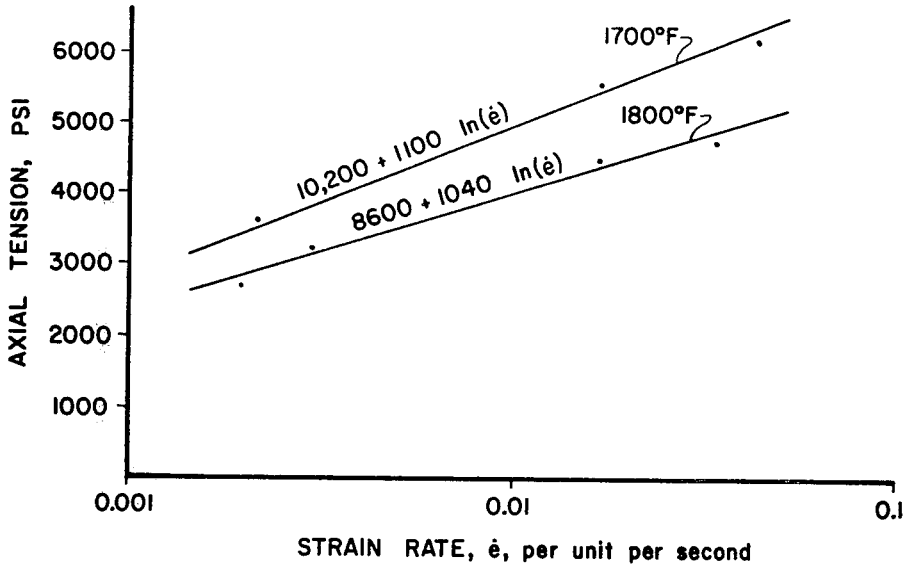
FIG. 4 is a plot of stress versus logarithm of strain rate for a metal strip under uniform tension across its width.

FIG. 4 shows typical actual experimental results for mild steel at temperatures of 1700° F. and 1800° F. These data can be expressed as a log-linear equation. For stresses in the 1000 to 10,000 psi range, the stress vs. strain-rate (i.e., time rate of change of strain) relation can be expressed as a log-linear equation of the form:

$$\sigma = K_1 + K_2 ln(\dot{e}) \quad (1)$$

wherein, $\sigma$ = stress (psi)

$\dot{e}$ = strain-rate (in/in/sec)

$K_1$ & $K_2$ = constants representing the intercept and slope of the equation for a particular material at a particular temperature.

For mild steel at 1700° F., as an example, and in the region of 1% strain, the relationship is approximately:

$$\sigma = 10200 + 1100\ ln(\dot{e}) \quad (2)$$

For mild steel at 1800° F., the relationship will be approximately:

$$\sigma = 8600 + 1040\ in(\dot{e}) \quad (3)$$

Experimental data for the values of $K_1$ and $K_2$ have been developed for a range of temperatures and materials and such data can be duplicated in any metallurgical testing facility by well-known methods such as that set forth in the Nadai et al article cited above.

These relationships can be stored in a computer (i.e., computer 51 in FIG. 1) in any convenient form such as tabular or as equations such as those cited above.

Figure 5:
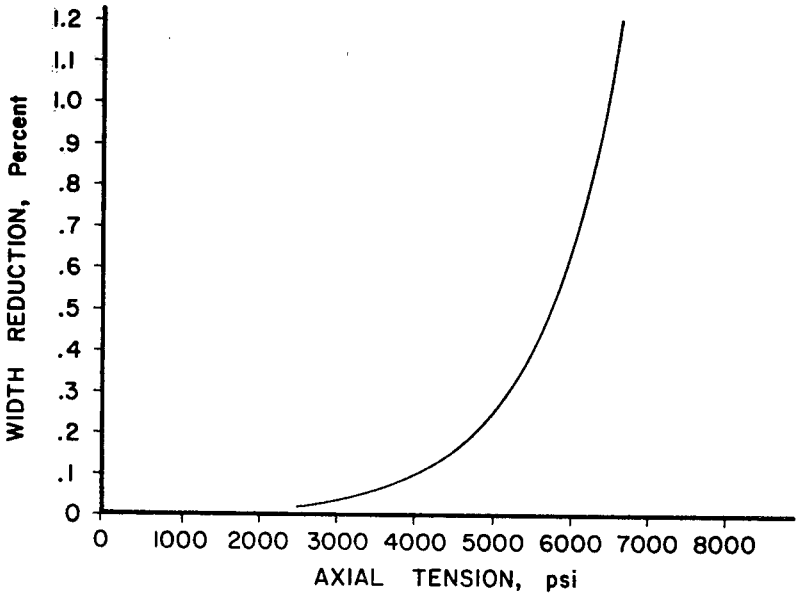
FIG. 5 is a plot of percent strip width reduction versus tension at a 2,000 foot per minute strip delivery speed for a uniform strip tension profile.
Figure 6:
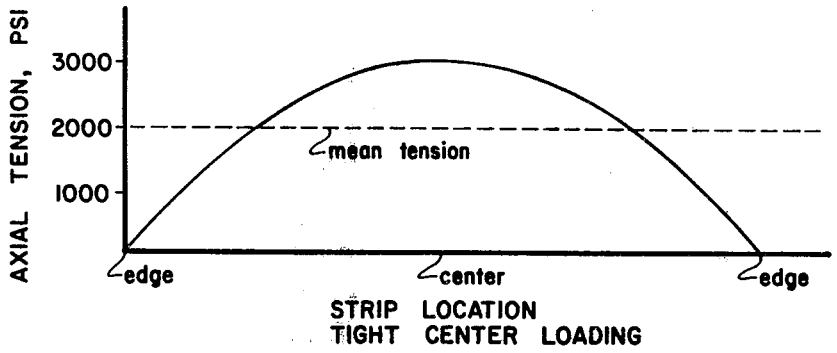
FIG. 6 is a plot of tension in the strip across the width of the strip when the center of the strip is under greatest tension.
Figure 7:
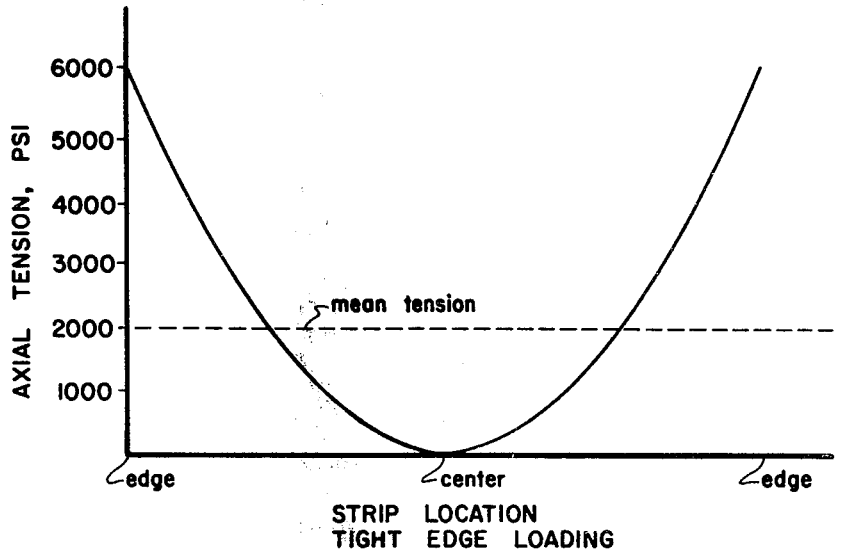
FIG. 7 is a plot of tension in the strip across the width of the strip when the edges of the strip are under greatest tension.

Equations (1), (2) and (3) describe the relationship between stress and axial strain rate for conditions of axial tension. It is necessary that this information be correlated to width reductions for various conditions of interest. An assumption can be made that, for small interstand strains, the percent width reduction and percent thickness reduction are each half of the percent length increase. This is a reasonable assumption because Poisson's Ration, the ratio of transverse strain to axial strain, approaches one-half because volume remains substantially constant in plastic deformation. Having thus determined the relationship between axial tension and transverse strain rate, the percent width reduction due to axial tension also can be determined FIG. 5 is derived from equation (2) and is a plot of percent width reduction between mill stands versus average interstand tension for an average interstand temperature of 1700° F. and a transit time corresponding to a workpiece speed of 2,000 feet per minute. In order to plot the curve of FIG. 5, it has been assumed that the mill stands are spaced a known constant distance and that the tension applied across the width of the strip 22 is uniform. A significant problem exists, however, because it is difficult, if not impossible, to achieve uniform tension across the width of the strip under day to day operating conditions. It therefore is necessary to determine the effect of non-uniform tensile stresses on width reduction before high interstand tension levels can be effectively applied. FIGS. 6 and 7 illustrate "tight center" and "tight edge" conditions, respectively, of a typical strip 22 being rolled in a hot strip mill. The distributions are assumed to be parabolic and the depictions indicate that for a strip being rolled at a mean tension of 2000 psi, and under greatest tension at its center, the maximum tension differential which can be tolerated before waviness appears is 3000 psi. Waviness will appear in a strip being rolled whenever tension in a portion of the strip drops to zero. FIG. 7 illustrates that a strip having more tension at its edges than at its center can tolerate a maximum tension differential of 6000 psi before waviness appears.

Figure 8:
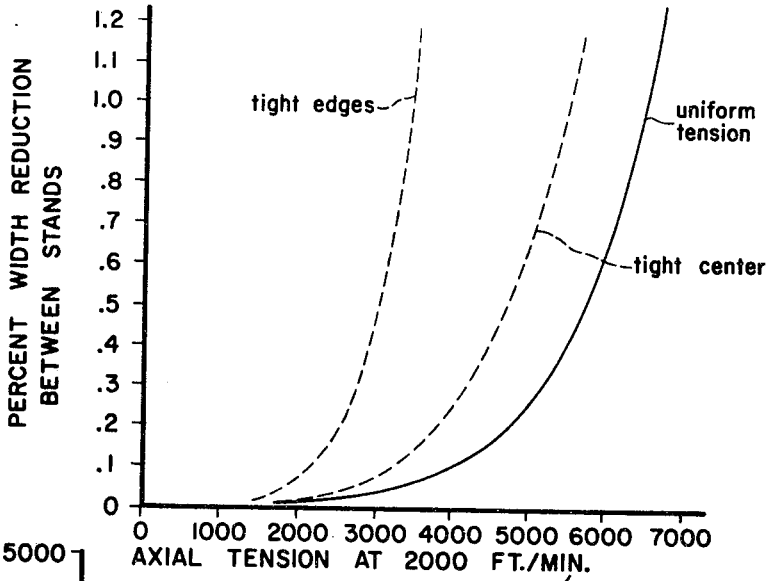
FIG. 8 is a plot of percent strip width reduction versus tension at a 2,000 foot per minute strip delivery speed for different strip tension profiles.

The importance of these curves becomes apparent when the width reduction for a given strip under different tensile loadings is explored. In FIG. 8, a family of curves is plotted for a particular grade of strip steel at 1700° F. and under three different tensile loadings: uniform loading, tight edge loading and tight center loading. It has been assumed that the strip is being rolled at a speed of 2000 feet per minute and that the mill stands are spaced a known constant distance. Because the temperature of the strip decreases as it passes through the mill, a temperature of 1700° F. approximates that in a typical strip mill in the last interstand space.

The curves of FIG. 8 for the tight center and tight edge conditions are derived from the uniform width reducton case, for example, by integration by parts. According to this technique, the percentage width reduction at each element of the strip due to the local tension there is calculated from a curve similar to that of FIG. 5 for the particular material and temperature under consideration. The calculated percentage width reduction at that particular element is multiplied by the width of that element. The calculation is repeated for each of the other elements across the width of the strip and a family of curves like that in FIG. 8 can be plotted. The curves thus plotted can be stored in tabular form or can be converted back into log-linear relationships like that of equation (1). For example, mild steel in the region of one percent strain and under tight center conditions, will yield an approximate relationship.

$$\sigma = 7830 + 800 ln(\dot{\epsilon}), \text{ at } 1700^\circ \text{ F.} \quad (4)$$

Various relationships like those of equations (2), (3) and (4) can be calculated and stored by the computer 51.

Three aspects of these relationships are of particular interest. First, there is a pronounced "knee" in these curves, above which strain increases sharply with tension. Second, the allowable stress levels drop quickly as the upstream stands are approached due to the combined effects of increasing temperature and increasing transit time between mill stands. The third aspect relates to the uniform tension assumption. All nonuniform tension distributions produce greater width reductions than uniform tension distributions because of the nonlinear stress-strain rate relationship. Because the tight edge tension distribution produces more extreme stress concentration than the tight center condition, the corresponding width reduction may be substantially greater. For example, at a mean tension of 3000 psi, a uniform tension distribution shown only a 0.04 percent width reduction, while a tight center tension distribution shows a 0.07 percent width reduction. A tight edge tension distribution, however, shows a 0.56 percent width reduction. Clearly, if a strip is being rolled under tight edge conditions and interstand tensions are permitted to reach even into the 3000 psi range, width reductions of one percent or more are possible. Based on the foregoing phenomenon, which until the present invention has not been understood, at least in the context of hot strip mill operaion, hot strip mill practice has been to reduce interstand tension levels to the order of a maximum of 1500 psi in order to avoid any tension-induced problems. Stated differently, in the absence of a clearer understanding of interstand plastic flow relationships, the only reliable recourse has been to reduce interstand tension to levels which produce acceptable width reduction under the most unfavorable combinations of tension distribution, temperature and rolling speed. As a reslut, the flatness-producing mechanisms which require the presence of high interstand tension have been substantially unused.

The invention contemplates a technique for calculating optimum interstand tension levels for the conditions which exist at each interstand space, and for controlling the interstand tension regulation means to produce the calculated optimum tension levels. Essentially, an acceptable width reducton of a strip 22 due to tension imposed between roll stands is sought from predetermined considerations. In a typical hot strip mill an acceptable width reducton might be 0.5 inch from the mill stand F1 through the mill stand F7. Because the rolling process might widen the strip 22 about 0.25 inch, the total acceptable tension-induced width reduction from mill stand F1 through mill stand F7 might be about 0.75 inch. The tension-induced reduction is distributed over the interstand spaces, favoring the latter stands where the percentage elongation errors and flatness problems are most troublesome. A typical distribution of tension-induced width reduction might be, for example, 50 percent in the F6–F7 space, 30 percent in the F5–F6 space, and 20 percent in the F4–F5 space. Tension levels upstream of mill stand F4 would remain at their normal, low levels.

Rolling speeds and temperatures are determined in advance of workpiece arrival at the finishing train 22. The Computer Control Patent describes one such technique. For a typical steel workpiece, rolling speeds leaving the last mill stand F7 will be 1000 to 3000 feet per minute and corresponding temperatures will range from 1600° F. to 1700° F. The transit times for the F6–F7 space typically are 0.5 to 1.5 seconds. For each interstand space, values for the workpiece temperature entering that space and the workpiece velocity while traversing that space can be calculated and stored by the computer 51.

A further objective of the rolling schedule calculation is to achieve approximately uniform elongation in the successive reductions. A method for accomplishing this through proper choice of (strip) reductions is described in the Shape Control Patent. Computer calculated reduction schedules employing this or similar strategies can avoid (extreme) tight edge tension distributions. Manually controlled operations cannot be relied upon to avoid undesirable tension distributions.

The thickness reduction schedule and/or roll bending techniques are usually employed in a manner to produce a desired tension distribution. By erring in the direction of tight center conditions, excessively high local tensions are avoided.

Figure 9:
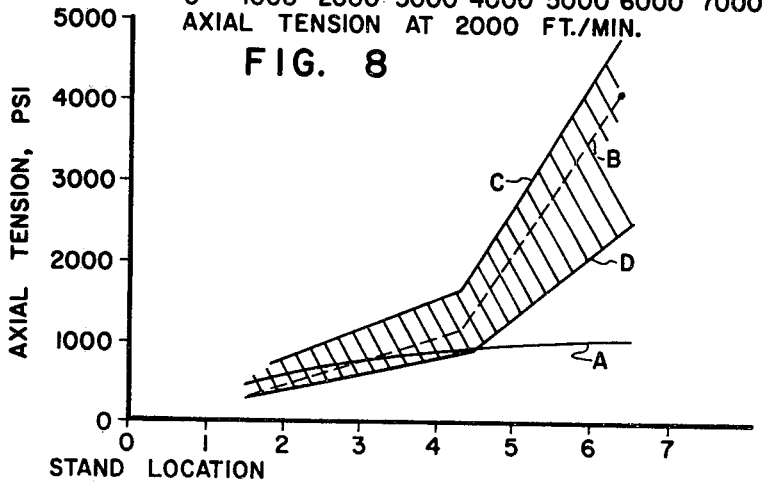
FIG. 9 is a plot of strip tension versus mill stand location, a typical prior art tension level being plotted and a tension level according to the invention being plotted; and, FIG. 10 is a block diagram representing the methodology of the present invention and its implementation in a hot strip mill.

Mean tension levels have been calculated for each interstand location. Referring to FIG. 9, typical conventional interstand tension levels are illustrated by the line marked "A". These tension levels between mill stands F1 and F2 are approximately 500 psi and increase to approximately 1050 psi between mill stands F6 and F7. Presently available mill control equipment automatically maintains tension in the strip at preselected low levels such as that shown in FIG. 9. Tensions calculated and used in accordance with this invention will fall into the range illustrated by the shaded area bounded by curves C and D in FIG. 9.

Figure 10:
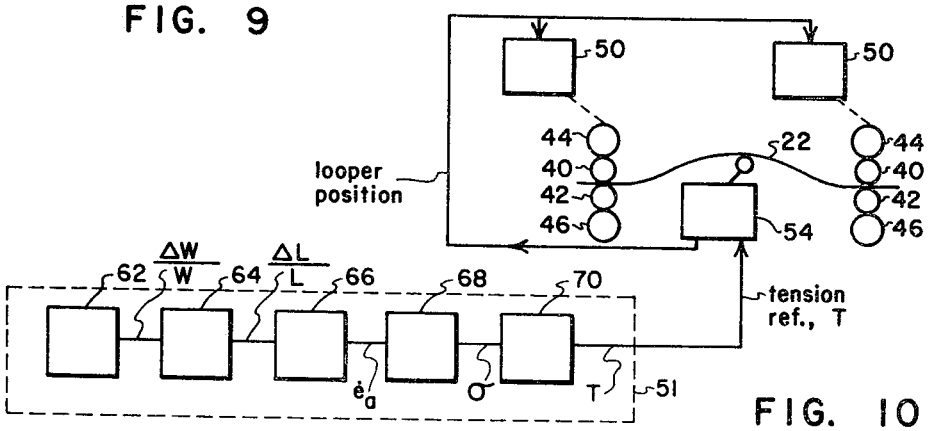

FIG. 10 is a block diagram representation of the technique by which the tension levels according to the invention are calculated and by which the hot strip mill is controlled to achieve desirable flatness properties in a strip 22. The computer 51 is indicated in outline form. As part of the computer 51, a calculator 62 determines the maximum allowable per unit width reduction ($\Delta W/W$) based on a predetermined acceptable width change $\Delta W$. A calculator 64 determines the maximum allowable length increase ($\Delta L/L$) based on the equation:

$$\Delta L/L = 2(\Delta W/W). \quad (5)$$

Knowing the properties of the material being rolled, its temperature, and its rolling speed, axial strain rate, $\dot{e}_a$, can be determined from the equation:

$$\dot{e}_a = \frac{2(\Delta W/W)}{t} = \frac{(\Delta L/L)}{t} \quad (6)$$

wherein, t = time required for a point on the strip to traverse the interstand space.

Equation (6) is solved by the calculator 66.

Based on the value of $\dot{e}_a$ calculated by the calculator 66, a calculator 68 solves an equation like that of equation (1) to determine axial stress. The calculator 68 can be programmed in advance for different values of K1 and K2 depending upon the properties of the particular material being rolled, its temperature, its strain level and so forth. In essence, equations (2), (3), (4) and other similar appropriate equations can be developed for all expected operating temperatures and materials and the equations, or equivalent tables, can be stored in the computer 51. Accordingly, during rolling of a particular strip 22, the calculator 68 will only have to select the proper stored relationship to determine axial stress as a function of axial strain rate.

Axial stress is translated into interstand tension through multiplication, in calculator 70, by the cross sectional area of the strip. The interstand tension is then applied as a reference to a normally included tension control means of any suitable type known in the art, for example, constant tension loopers 54 (FIG. 1). The tension established by the constant tension loopers is determined by torque motors and by the angle made by the looper and strip. This angle is maintained constant by adjusting drive motor speed with speed control means 50 to maintain constant looper position. Other means such as direct control of tension by interstand tensiometer working through stand speed control also can be employed. During acceleration of the mill to steady state rolling speeds, the permissible interstand tension levels are recalculated and tension levels are raised to the maximum permissible extent after each recalculation. The methodology described schematically in FIG. 9 is repeated separately for each interstand space in which high tension levels are desired. Typically, this would be between mill stands F4–F5, F5–F6 and F6–F7. Tension levels between the preceding mill stands would be set according to presently existing techniques.

EXAMPLE

Steel having 0.09% carbon and 0.40% manganese exhibited the following stress versus strain -rate relationship at 1700° F., for uniform tension:

$$\sigma = 10200 + 1100\ ln(\dot{e}_a). \quad (7)$$

allowing for the worst case tension profile similar to that in FIG. 6, the relationship is adjusted to:

$$\sigma = 7830 + 800\ ln(\dot{e}_a). \quad (8)$$

It will be assumed that 50% of a total width reduction of 0.50 inch is allowable in space F6–F7 and that the strip 22 is 80 inches wide. Calculator 62 will determine the maximum allowable per-unit width reduction as 0.003125. Calculator 64 will compute the maximum per-unit allowable length increase as 0.00625. Assuming that mill stands F6 and F7 are 18 feet apart and strip is traversing the F6–F7 space at 2000 feet per minute, an element of strip would require 0.54 seconds to travel from F6 to F7. The calculator 66 will calculate the axial strain-rate during this interval as 0.01157 per-unit per second.

Knowing the material and temperature, the calculator 68 will select from among stored relationships the relationship given by equation (8), in this example, and calculate the allowable axial stress at 4263 psi. Accordingly, an interstand tension reference corresponding to an axial stress of 4263 psi could be applied to the interstand tension regulating means 54. This procedure would be repeated for all interstand spaces, resulting in a tension practice illustrated as curve B in FIG. 7.

Provided the interstand tension levels are maintained at or slightly below the tension levels calculated in this manner, width reductions will be acceptable and waviness problems will be reduced. Since width reductions due to tension are predictable, they obviously may be compensated by corresponding increases in the strip width produced in the roughing mill 10.

Equally obvious is the fact that higher tensions need not be employed where strip dimensions are such that flatness problems are not usually encountered.

Although the invention has been described in its preferred form with a certain degree of particularity, it will be understood that the present disclosure of the preferred embodiment has been made only by way of example and that numerous changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. In a hot strip mill having at least two mill stands where a metal workpiece is compressed and reduced in thickness to form a strip, each mill stand having rolls, the rolls of each mill stand being rotatable at selected speeds by means of a mill control system so that the strip can be placed under tension during its passage between mill stands, a method for improving strip flatness, comprising the steps of:

(a) selecting a predetermined maximum width reduction which the strip will be permitted to undergo during its passage between adjacent mill stands;
(b) calculating, from predetermined relationships between stress and strain-rate, the tensile stress which will produce this width reduction; and
(c) regulating interstand tensile stress at or below the calculated tensile stress level.

2. The method of claim 1 wherein the relationship between stress and strain-rate is defined by equation:

$$\sigma = K_1 + K_2 \ln(\dot{e})$$

wherein, $\sigma$ = stress $\dot{e}$ = strain-rate $K_1$ and $K_2$ = constants representing the intercept and slope of the equaton for a particular material at a particular temperature.

3. In a hot strip mill having at least two mill stands where a metal workpiece is compressed and reduced in thickness to form a strip, each mill stand having rolls, the rolls of each mill stand being rotatable at selected speeds by means of a mill control system so that the strip can be placed under tension during its passage between mill stands, a method for improving strip flatness, comprising the steps of:
(a) selecting a predetermined maximum width reduction which the strip will be permitted to undergo during its passage between adjacent mill stands;
(b) calculating the transverse strain-rate in the strip resulting from the selected width reduction;
(c) calculating the axial strain-rate in the strip corresponding to the calculated transverse strain-rate in the strip based upon a predetermined relationship between transverse strain-rate and axial strain-rate;
(d) calculating the axial stress in the strip which will produce the calculated axial strain-rate; and,
(e) regulating the speed of the rollers in adjacent mill stands to apply axial stress to the strip at a level at or below the calculated axial stress.

4. The method of claim 3 wherein the calculated axial stress is calculated as a function of strain-rate, strip material and strip temperature.

5. The method of claim 3 wherein the relationship between axial strain-rate and axial stress also is corrected to allow for tension nonuniformity across the strip width.

6. In a hot strip mill having at least two mill stands where a metal workpiece is compressed and reduced in thickness to form a strip, each mill stand having rolls, the rolls of each mill stand being rotatable at a selected speed so that the strip may be placed under tension during its passage between mill stands, a method for improving strip flatness during the rolling process, comprising the steps of:
(a) selecting a predetermined maximum width reduction which the strip will be permitted to undergo during its passage between mill stands;
(b) establishing the degree of transverse strain-rate in the strip needed to achieve the selected width reduction as a function of a fixed mill stand spacing and a predetermined strip speed between adjacent mill stands;
(c) establishing the degree of axial strain-rate in the strip corresponding to the established transverse strain-rate in the strip based on a predetermined relationship between transverse strain-rate and axial strain-rate;
(d) establishing the axial stress in the strip which will produce the established axial strain rate; and,
(e) regulating the speed of the rollers in adjacent mill stands to apply axial stress to the strip such that the established axial strain-rate is not exceeded.

7. The method of claim 6, wherein the relationship between axial stress ($\sigma$) and axial strain-rate ($\dot{e}_a$) is determined from a series of relationships based on the equation:

$$\sigma = K_1 + K_2 \ln(\dot{e}_a)$$

where $K_1$ and $K_2$ are constants dependent upon the strip material properties, the strip temperature, the strain which the material experiences, and the nature of the axial stress distribution across the strip width.

8. The method of claim 7, wherein permissible axial stress levels are recalculated during acceleration of the mill to higher rolling speeds, and interstand tension levels are raised to the maximum permissible extent after each recalculation.

9. In a hot strip mill having at least two mill stands where a metal workpiece is compressed and reduced in thickness to form a strip, each mill stand having rolls, the rolls of each mill stand being rotatable at selected speeds by means of a mill control system so that the strip may be placed under tension during its passage between mill stands, a method improving strip flatness during the rolling process, comprising the steps of:
(a) selecting a predetermined maximum width reduction ($\Delta W$) which the strip will be permitted to undergo between mill stands;
(b) establishing the maximum per unit width reduction ($\Delta W/W$) acceptable in the strip, wherein W is the strip width upon entering an interstand space;
(c) establishing the degree of axial per unit strain ($\Delta L/L$) in the strip associated with said maximum acceptable per unit width reduction in accordance with the relationship $\Delta L/L = 2\ \Delta W/W$, wherein $\Delta L$ equals the elongation of a strip element of length L while traversing an interstand space;
(d) establishing the axial strain-rate ($\dot{e}_a$) in accordance with the formula:

$$\dot{e}_a = \frac{\Delta L}{L} / t$$

wherein, t equals the time required for a point on the strip to transverse the interstand space;
(e) determining the axial stress ($\sigma$) needed to produce the established axial strain rate ($\dot{e}_a$) from an equation of the form:

$$\sigma = K_1 + K_2 \ln(\dot{e}_a)$$

wherein $K_1$ and $K_2$ are constants dependent upon the strip material properties, the strip temperature, the strain which the material experiences, and the nature of the tension distribution to which the strip is subjected; and,
(f) regulating the speed of the rollers in adjacent mill stands to apply axial stress to the strip so that the calculated axial stress is approached or attained.

10. The method of claim 9 wherein permissible axial stress levels are recalculated during acceleration of the mill to higher rolling speeds, and interstand tension levels are raised to the maximum permissible extent after each recalculation.

11. The method of claim 9, wherein the method is applied only to the latter mill stands of a multiple mill stand finishing train.

12. In a hot strip mill having at least two mill stands where a steel workpiece is compressed and reduced in thickness to form a strip, each mill stand having rolls, the rolls of each mill stand being rotatable at selected speeds by means of a mill control system so that the strip may be placed under tension during its passage between mill stands, a method for improving strip flatness during the rolling process, comprising the steps of:

(a) selecting a predetermined maximum width reduction ($\Delta W$) which the strip will be permitted to undergo between the latter mill stands of a multiple mill stand finishing train;

(b) establishing the maximum per unit width reduction ($\Delta W/W$) acceptable in the strip, wherein W is the strip width upon entering an interstand space;

(c) establishing the degree of axial per unit strain ($\Delta L/L$) in the strip associated with said maximum acceptable per unit width reduction in accordance with a value of Poisson's Ratio of approximately $\frac{1}{2}$ whereby $\Delta L/L = 2\ \Delta W/W$, wherein $\Delta L$ equals the elongation of a strip element of length L while traversing an interstand space;

(d) establishing the axial strain-rate ($\dot{e}_a$) in accordance with the formula:

$$\dot{e}_a = \frac{\Delta L}{L} / t$$

wherein, t equals the time required for a point on the strip to transverse the interstand space;

(e) determining the axial stress ($\sigma$) needed to produce the established axial strain rate ($\dot{e}_a$) from an equation of the form;

$$\sigma = K_1 + K_2\ ln(\dot{e}_a)$$

where $K_1$ and $K_2$ are constants dependent upon strip material properties, the strip temperature, the strain which the material experiences, and the nature of the tension distribution to which the strip is subjected;

(f) calculating the interstand tension value corresponding to said axial stress;

(g) applying the calculated interstand tension value to interstand tension regulation means;

(h) recalculating permissible interstand tension levels during acceleration of the mill to higher rolling speeds and raising interstand tension levels to the maximum permissible extend after each recalculation.

* * * * *